United States Patent [19]

Nelson

[11] Patent Number: 4,674,795

[45] Date of Patent: Jun. 23, 1987

[54] CHAIR FRAME

[76] Inventor: Jonathan M. Nelson, 36 Butler St., Kingston, Pa. 18704

[21] Appl. No.: 883,963

[22] Filed: Jul. 10, 1986

[51] Int. Cl.[4] ..... A47C 3/04

[52] U.S. Cl. ..... 297/239; 297/294; 297/440

[58] Field of Search ..... 297/239, 294, 295, 296, 297/440, 445

[56] References Cited

U.S. PATENT DOCUMENTS

| | | | |
|---|---|---|---|
| 2,848,040 | 8/1958 | Chernivsky | 297/296 |
| 3,847,433 | 11/1974 | Acton et al. | 297/239 |
| 4,522,444 | 6/1985 | Pollock | 297/239 |

FOREIGN PATENT DOCUMENTS

| | | | |
|---|---|---|---|
| 560673 | 10/1932 | Fed. Rep. of Germany | 297/294 |
| 827845 | 1/1952 | Fed. Rep. of Germany | 297/295 |
| 511307 | 8/1939 | United Kingdom | 297/239 |
| 596913 | 6/1948 | United Kingdom | 297/239 |

*Primary Examiner*—Francis K. Zugel

*Attorney, Agent, or Firm*—Benasutti and Murray

[57] ABSTRACT

A chair frame for supporting a seat and seat back in a novel manner. The material of the seat, such as fabric or leather, is supported by the frame in partial tension to avoid sagging and to allow independent torsional movement of the seat portions supporting each leg of the chair user. The chair frame geometry and the tensioned seat provide a flexible chair that provides a new seating experience that combines lounge and rocking chair type characteristics. Additionally, the chair frame can be provided as a one piece rigid frame or a stackable, foldable, or collapsible frame.

14 Claims, 15 Drawing Figures

FIG. 1
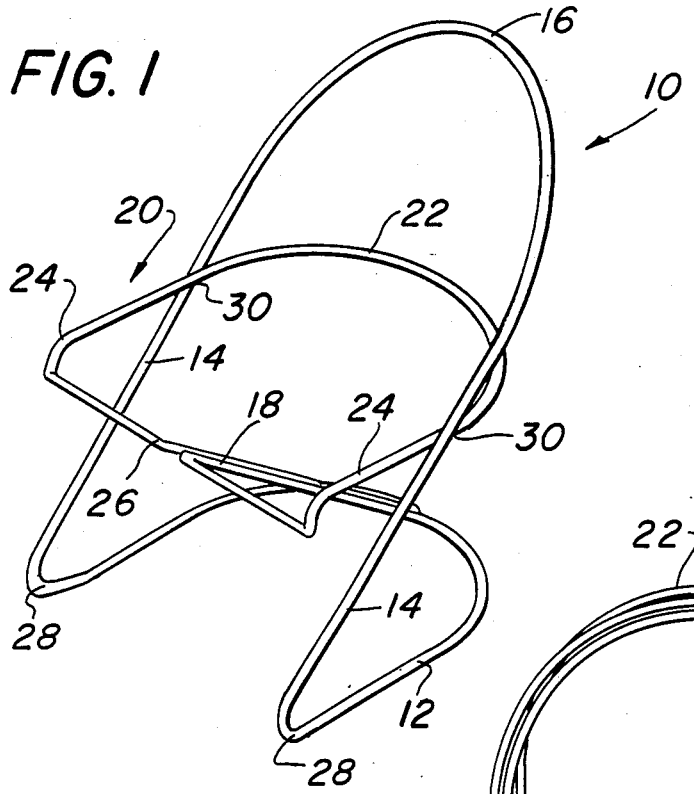
FIG. 3
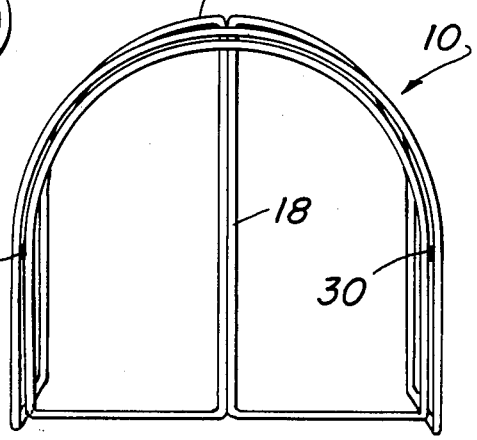
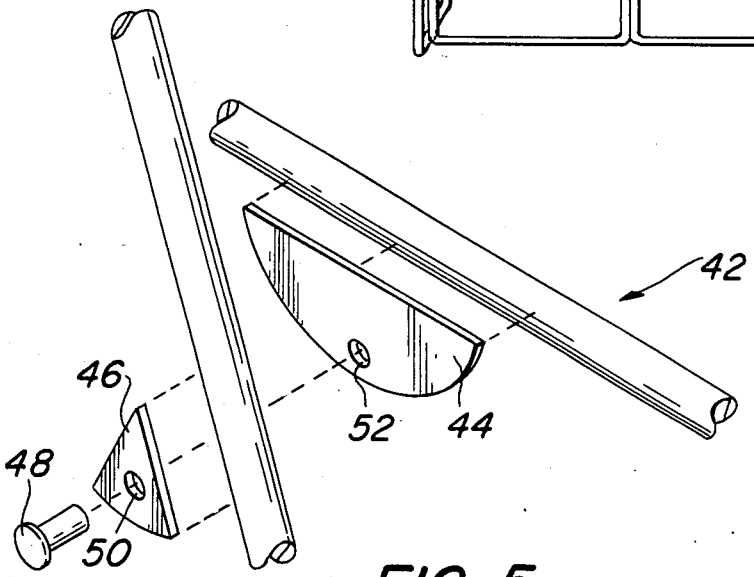
FIG. 5

FIG. 4
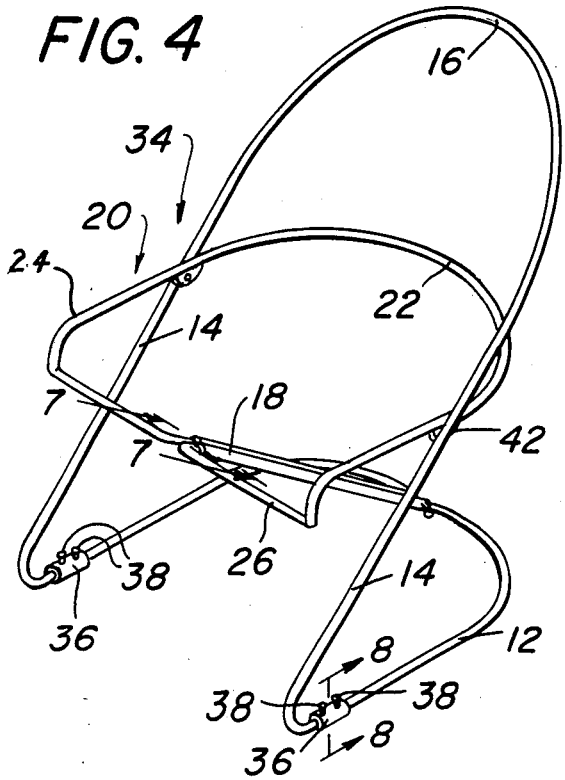
FIG. 7
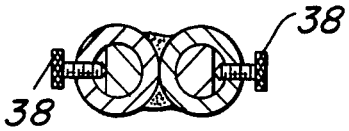
FIG. 8
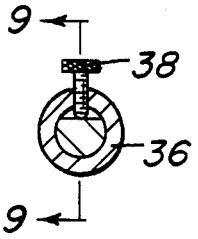
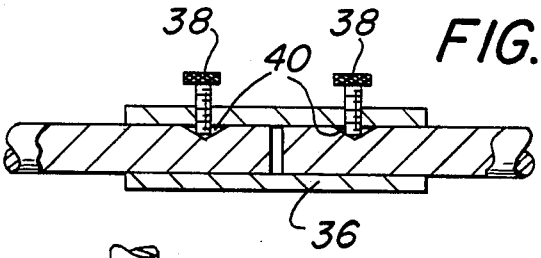
FIG. 9
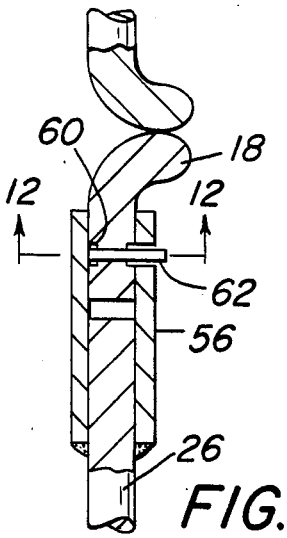
FIG. 11
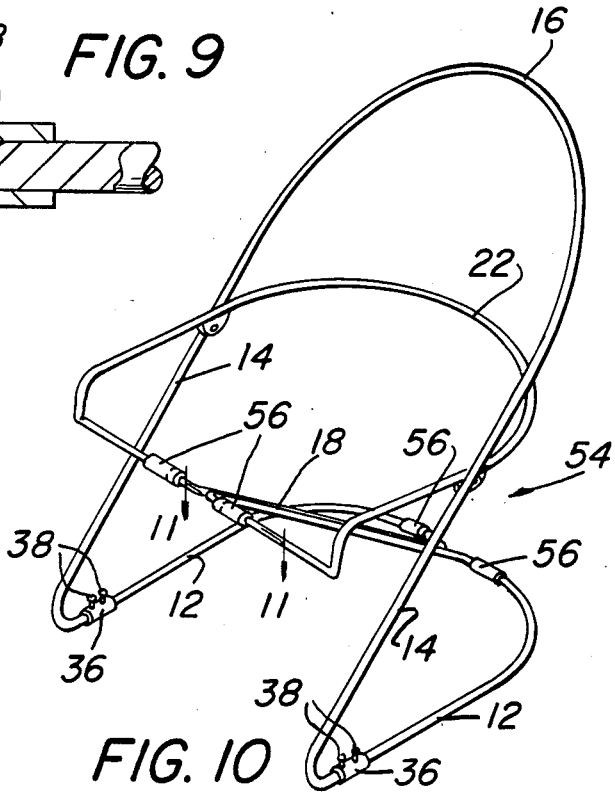
FIG. 10

FIG. 13
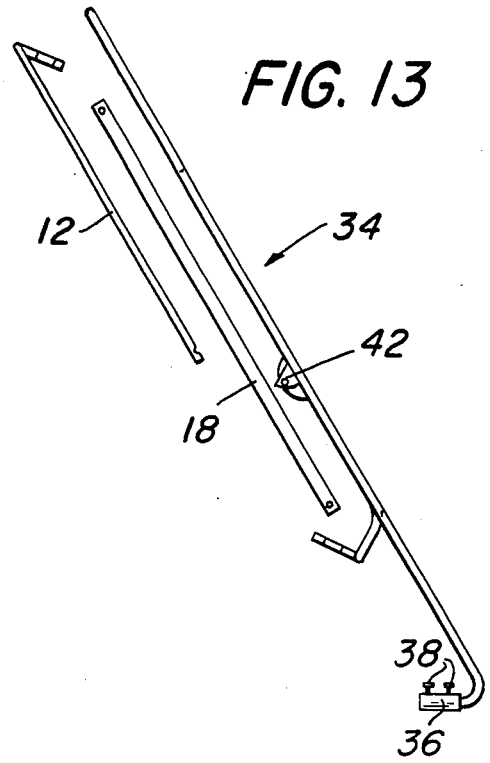
FIG. 14
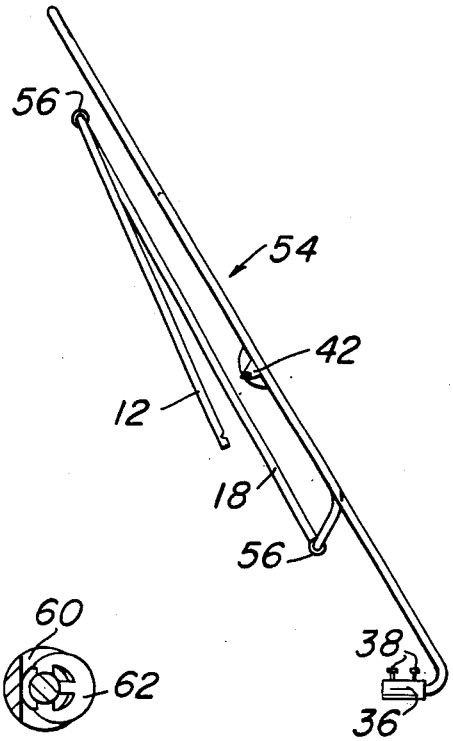
FIG. 12
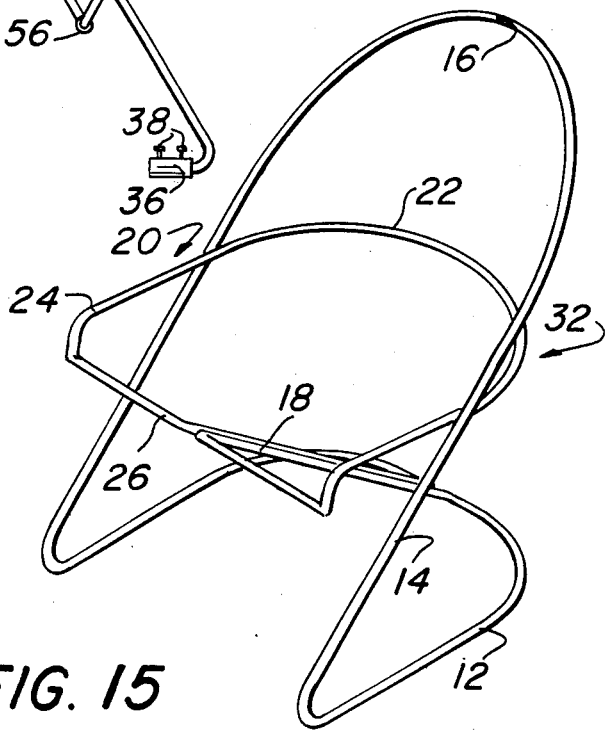
FIG. 15

CHAIR FRAME

BACKGROUND OF THE INVENTION

This invention relates to a chair frame, which creates a cantilever seat with individual leg support portions capable of independent motion to provide maximum comfort, while providing support for the material, such as fabric or leather, of the seat and seat back.

Fabric chairs typically provide a fabric seat slung from a chair frame surrounding the periphery of the fabric. This arrangement is often uncomfortable because the seat sags in the middle and cannot provide independent leg support for each leg to correspond to the movement of a person seated on the chair.

Additionally, steel chair frames are typically rigid and unforgiving, and therefore they do not allow for shifting of the users weight, changes in seated posture, or rocking movement of the user.

SUMMARY OF THE INVENTION

It is accordingly an object of the present invention to provide a chair frame for supporting a fabric or leather seat and seat back.

It is another object of the present invention to provide a chair frame that can support a fabric or leather seat partially in tension to avoid sagging of the front portion of the fabric or leather seat.

It is a further object of the present invention to provide a chair frame that can support a seat that allows independent torsional movement of the portions of the seat that support a user's legs.

It is still another object of the present invention to provide a chair frame that can be used with easily changeable fabric or leather seats and seat backs.

It is yet a further object of the present invention to provide a chair frame that gives the appearance of being made from a single continuous piece of metal.

It is an additional object of the present invention to provide a chair frame that is collapsible by separating the frame into several component parts.

It is a still further object of the present invention to provide a chair frame that can be folded substantially flat.

It is yet another object of the present invention to provide rigid chair frames that are stackable.

The present invention provides a chair frame that can support a fabric or leather seat and fabric or leather seat back in a novel manner. The front part of the fabric seat is supported in tension with the front frame bar lower than the seat to reduce interference with a users legs by minimizing sagging so that the legs of the chair user are supported above the metal support frame. This allows the portion of the seat supporting each leg to be capable of independent torsional movement for maximum comfort of the chair user. The geometry of this chair allows for chair flexure in response to a particular users chair posture and individual seating requirements, such as rocking movement of the user, without the danger of the chair turning over. This danger is avoided because the chair base never leaves contact with the floor since any movement is taken up in the flexure of chair frame members located above the base. Additionally, minor modifications permit the chair frame to be made stackable, collapsible or foldable.

The invention features, in one aspect, a chair frame having a base, a seat back member, two side compression support members connected to the base and continuous with the seat back member, a center diagonal tension member connected to the base, and a cantilever seat frame that defines a seat portion of the chair frame. The chair frame includes a cantilevered rear outer seat frame member located in a substantially horizontal plane and rigidly affixed to each of the side compression support members at substantially the center of the seat portion. The seat frame also includes two horizontal side leg supports, each one of which is connected to the cantilevered rear outer seat frame at one of the points where the outer seat frame member is rigidly affixed to each of the side compression support members. Finally, the seat frame includes a front outer seat frame member which extends vertically downward and across from the two horizontal side leg supports and is connected to the center diagonal tension member.

In preferred embodiments of the chair frame each of the horizontal side leg supports is capable of independent torsional movement via the split front outer seat frame member. The chair base extends outward at the point where the base and the side compression support members are connected so that a plurality of the chair frames are stackable.

The invention features, in another aspect, a collapsible chair frame having a base, a seat back member, two side compression support members connected continuous with the seat back member and connected to the base by removable sleeves, a center diagonal tension member removably connected to the base, and a cantilever seat frame that defines a seat portion of the collapsible chair frame. The collapsible chair frame includes a cantilever rear outer seat frame member located in a substantially horizontal plane and rotatably attached to each of the side compression support members at substantially the center of the seat portion. The collapsible chair frame also includes two horizontal side leg supports, each one of which is connected to the cantilever rear outer seat frame member at one of the points where the cantilevered rear outer seat frame member is rotatably attached to each of the side compression support members. Finally, the collapsible seat frame includes a front outer seat frame member which extends vertically downward and across from the two horizontal side leg supports and is removably connected to the center diagonal tension member.

In preferred embodiments of the collapsible chair frame each of the removable sleeves includes a tubular member having threaded openings substantially transverse to the sleeve's longitudinal axis for receiving fastening screws to hold the sleeve in contact with the side compression support member and the base. The diagonal tension member of the collapsible ohair frame includes threaded openings at both ends of the tension member; the openings are substantially transverse to the longitudinal axis of the tension member and capable of receiving fastening screws to hold the tension member in contact with the base and the front outer seat frame member, so that removal of the fastening screws allows separation of the tension member from the chair frame. The cantilevered seat frame of the collapsible chair frame is rotatably attached to each of the side compression support members by a pivot assembly. Each of the horizontal side leg supports of the collapsible chair frame is capable of independent torsional movement.

The invention features, in still another aspect, a foldable chair frame having a base, a seat back member, two side compression support members connected to the seat back member and connected to the base by removable sleeves, a center diagonal tension member rotatably connected to the base, and a cantilever seat frame defining a seat portion of the foldable chair frame. The foldable chair frame includes a cantilevered rear outer seat frame member located in a substantially horizontal plane and rotatably attached to each of the side compression support members at substantially the center of the seat portion. The foldable chair frame also includes two horizontal side leg supports, each one of which is connected to the cantilevered rear outer seat frame member at one of the points where the rear outer seat frame member is rotatably attached to each of the side compression support members. Finally, the foldable chair frame includes a front outer seat frame member which extends vertically downward and across from the horizontal side leg supports and is rotatably connected to the center diagonal tension member.

In preferred embodiments of the foldable chair frame each of the removable sleeves includes a tubular member having threaded openings substantially transverse to the sleeve longitudinal axis for receiving fastening screws to hold the sleeve in contact with the side compression support member and the base. The cantilevered seat frame of the foldable chair frame is rotatably attached to each of the side compression support members by a pivot assembly. Each of the horizontal side leg supports of the foldable chair frame is capable of independent torsional movement. The end of the center diagonal tension member of the foldable chair frame which is rotatably connected to the base further includes a pair of collars; each collar is welded to the base and rotatably connected to the tension member. The end of the center diagonal tension member of the foldable chair frame which is rotatably connected to the front outer seat frame member further includes a pair of collars; each collar is welded to the front outer seat frame member in rotatably connected to the tension member.

All the features and advantages of the invention will be apparent from the following detailed description of the preferred embodiments and from the claims.

For a full understanding of the present invention, reference should now be made to the following description and the accompanying drawings.

BRIEF DESCRIPTION OF THE DRAWINGS

FIG. 1 is a perspective view of a preferred embodiment of the chair frame which is fully welded and stackable.

FIG. 3 is a top plan view of the chair frame shown in FIG. 1.

FIG. 4 is a perspective view of an alternate embodiment of the chair frame which is collapsible and separable into several parts.

FIG. 5 is an exploded view of the pivot arrangement shown in FIG. 4.

FIG. 7 is a cross-sectional view of the center diagonal tension member shown in FIG. 4 taken along lines 7—7 of FIG. 4.

FIG. 8 is a cross-sectional view of the removable sleeve shown in FIG. 4 taken along line 8—8 of FIG. 4.

FIG. 9 is a cross-sectional view of the removable sleeve shown in FIG. 8 taken along line 9—9 of FIG. 8.

FIG. 10 is a perspective view of another alternate embodiment of the chair frame which is foldable.

FIG. 11 is a cross-sectional view of the rotatable collar shown in FIG. 10 taken along line 11—11 of FIG. 10.

FIG. 12 is a cross-seotional view of the rotatable oollar shown in FIG. 11 taken along line 12—12 of FIG. 11.

FIG. 13 is a side view of the chair frame shown in FIG. 4 shown collapsed into its removable parts.

FIG. 14 is a side view of the chair frame shown in FIG. 10 shown in its folded position.

FIG. 15 is another alternate embodiment of the chair frame which is fully welded but not stackable.

DETAILED DESCRIPTION OF THE PREFERRED EMBODIMENTS

Figure 2:
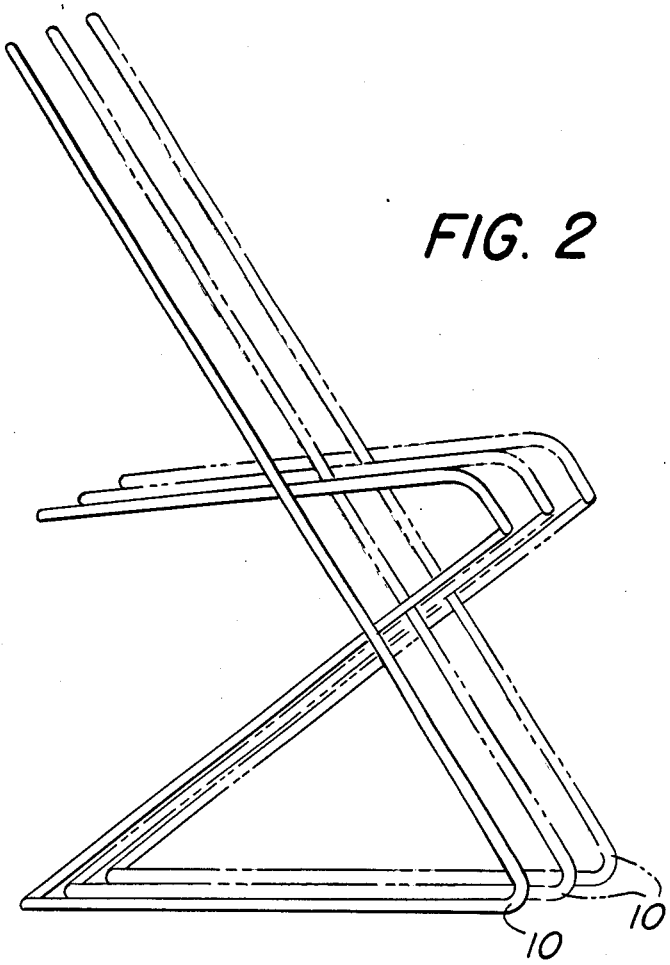
FIG. 2 is a side view of the chair frame shown in FIG. 1 with phantom chairs shown stacked.

Referring to FIGS. 1 and 3, there is shown a perspective and top plan view respectively, of a preferred embodiment of the chair frame, generally designated 10. Chair frame 10 includes a base 12, two side compression support members 14, a seat back member 16, center diagonal tension member 18, and cantilever seat frame 20. Cantilever seat frame 20 defines a seat portion which has cantilever rear outer seat frame member 22, two horizontal side leg supports 24 and front outer seat frame member 26. The frame in the general vicinity of the junction of the base member 12 and the two side compression support members 14, designated 28, is bent slightly outward. Additionally, welded joints 30 are provided for attaching the two side compression support members 14 to the cantilever seat frame 20.

The use and operation of the preferred embodiment of the chair frame, shown in FIGS. 1 and 3, will now be described. A flexible material seat back (not shown), typically made of fabric or leather, is held in place by VELCRO material or other means known to those in the art and is placed over the seat back member 16. A flexible material seat (not shown), typically made of fabric or leather, is also attached to the cantilever rear outer seat frame member 22 and to the two horizontal side leg supports 24 of the cantilever seat frame 20. The rear section of the fabric or leather seat can be held in place with VELCRO material, snaps, tensioned cable or any other fastener which will be known to those in the art. The front section of the fabric or leather seat will be held in place on the cantilever seat frame 20 by a tension rope (not shown) extending around the circumference of seat frame 20 and running through loops or straps which overlap the frame and are held around the frame via the tensioned rope. The use of a fabric or leather seat back held in place by VELCRO material and a fabric or leather seat held in place by both VELCRO material and a tension rope allows easy removal of the seat back and the seat for cleaning and for changing to fabric or leather seats and seat backs of different colors.

Once the fabric or leather seat back and seat are attached to seat back member 16 and cantilevered seat frame 20 respectively, the chair frame 10 can support a user. A user sitting on the fabric or leather seat attached to cantilever seat frame 20 will find most of his/her weight supported by cantilevered rear outer seat frame member 22 located behind joints 30. This will cause both horizontal side leg supports 24 and front outer seat frame member 26 to be in torsion. The center diagonal tension member 18 will counteract the forces in the horizontal side leg supports 24 and the front outer seat frame member 26. However, the unsupported periphery of both horizontal side leg supports 24 and front outer seat frame member 26 allow independent torsional movement of each side leg support 24 and the front outer seat frame member 26 to provide maximum comfort for the user. Additionally, front outer seat frame member 26 is generally U-shaped and extends downward from the front of the side leg supports 24. This allows the seat fabric or leather, stretched in tension between the two horizontal side leg supports 24, to support the user's legs above the front outer seat frame member 26.

When chair frames 10, with or without fabric or leather seat backs and fabric seats, are not in use they can be stacked for convenient storage as shown in FIG. 2. Outward extensions 28 of the frame allow chair frames 10 to be easily slipped over one another for stacking. Alternatively, chair frame 10 can be provided without outward extensions 28, as shown in FIG. 15 by the chair frame generally designated 32. The embodiment of the chair frame shown in FIG. 15 operates the same as chair frame 10 except that a plurality of frames 32 cannot be stacked when not in use.

In an alternate embodiment of the invention the chair frame can be provided as a collapsible frame. Referring to FIG. 4, a collapsible chair frame, generally designated 34, is shown. Chair frame 34 is substantially the same as chair frame 10 in geometry and operation. The only difference is that chair frame 34 can be separated into several pieces and collapsed as shown in FIG. 13.

Chair frame 34 includes two removable sleeves 36 (shown in FIGS. 8 and 9) into which base 12 and side compression support members 14 are inserted. Referring to FIGS. 8 and 9, removable sleeves 36 each include two fastening screws 38 which thread into threaded openings extending through the sleeve 36. Screws 38 when threaded into the openings in sleeve 36 extend into indentations 40 in base member 12 and side compression support members 14 and hold the members together.

Center diagonal tension member 18 is also provided with removable attachment means at each end. Referring to FIG. 7, a cross-section of one end of tension member 18 shows the attachment means located at each end of tension member 18. The ends of the base member 12 and the ends of the front outer seat frame member 26 are inserted into respective ends of the center diagonal tension member 18. Fastening screws 38, identical to the screws used with removable sleeves 36, are then threaded into threaded holes at both ends of tension member 18. Screws 38 are then threaded down snug against the ends of the base member 12 and the front outer seat frame member 26 until they are held firmly in place. Appropriate indentations (not shown) can be provided in the base member 12 and the front outer seat frame member 26 to receive fastening screws 38 and to insure positive engagement of the members by screws 38.

Figure 6:
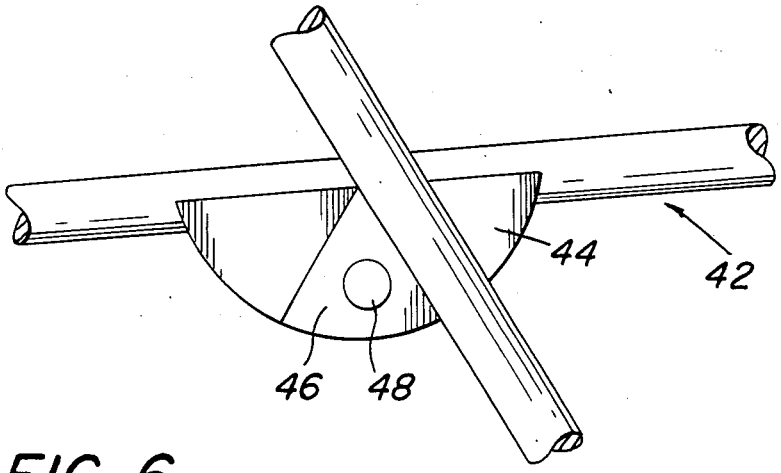
FIG. 6 is an enlarged view of the pivot arrangement shown in FIGS. 4, 5 and 10.

To collapse chair frame 34 screws 38 are loosened in removable sleeves 36 and center diagonal tension member 18. Tension member 18 is then separated from chair frame 34. Removable sleeves 36 can be removed from chair frame 34 or one side of the sleeve can be left attached to the frame as shown in FIG. 13. The side compression support members 14 and the seat back member 16 are attached together by a pivot assembly 42 and can be folded substantially parallel with cantilever seat frame 20. The pivot assembly, shown assembled in FIG. 6 and in an exploded view in FIG. 5, includes a fixed pivot plate 44 rigidly attached to cantilever seat frame 20 and a fixed pivot plate 46 rigidly attached to the side compression support members 14. Pin 48 inserted through opening 50 in plate 46 and opening 52 in plate 44 holds cantilever seat frame 20 so it can rotate relative to said compression support members 14. The completely collapsed chair frame 34, shown in FIG. 13, includes separated base member 12 and center diagonal tension member 18, and folded cantilever seat frame 20, side compression support members 14, and seat back member 16.

In another alternate embodiment of the invention, the chair frame can be provided as a completely foldable frame. Referring to FIG. 10, a foldable chair frame, generally designated 54, is shown. Chair frame 54 is substantially the same as chair frame 34 in geometry and operation. The only difference is that center diagonal tension member 18 is connected to the front outer seat frame member 26 and the base member 12 by collars 56.

Collars 56, shown in cross-section in FIG. 11, are welded to the ends of the front outer seat frame member 26 and the ends of the base 12 inserted into the collars. The ends of the center diagonal tension member 18 inserted into collars 56 are rotatably connected to the collars. Referring to FIG. 11, this rotatable connection is created by cutting a groove 58 around the circumference of the ends of the tension member 18 that are inserted into collars 56. A corresponding groove 60 is cut approximately half way around the circumference of the collar that receives the grooved ends of the tension member 18. The grooved ends of tension member 18 are inserted into collars 56, and grooves 58 and 60 are lined up. A C-clip 62 (shown in FIGS. 11 and 12), is then inserted into grooves 60 and clipped onto grooves 58 on the ends of tension member 18. This allows collars 56 to freely rotate about the ends of tension member 18.

When the chair frame 54 is to be stored the base member 12 is separated from the side compression support members 14 at the removable sleeves 36. The chair frame 54 is then folded substantially flat as shown in FIG. 12.

There has thus been shown and described a novel chair frame which fulfills all the objects and advantages sought. Many changes, modifications, variations, and other uses and applications of the subject invention, will become apparent to those skilled in the art upon considering the specification and the accompanying drawings which disclose the preferred embodiments. All such changes, modifications, variations, and other uses and applications within the spirit and scope of the invention are deemed to be covered by the invention which is limited only by the claims which follow.

I claim:

1. A chair frame, comprising:

(a) a base;

(b) a seat back member;

(c) two side compression support members connected to said base and to said seat back member;

(d) center diagonal tension member connected to said base; and (e) a cantilever seat frame defining a seat portion of the chair frame, including:

(i) a cantilever rear outer seat frame member located in a substantially horizontal plane and rigidly affixed to each of said side compression support members at substantially the center of said seat portion;

(ii) two support members, each one of which is connected to said cantilever rear outer seat frame member at one of the points where said outer seat frame member is rigidly affixed to each of said side compression support members; and (iii) a front outer seat frame member which extends downward and across from said two support members and is connected to said center diagonal tension member and to said support members.

2. The chair frame of claim 1, wherein each of said side support members is capable of independent torsional movement.

3. The chair frame of claim 1, wherein portions of said base extend outward adjacent to the connection of said base and said side compression support members, so that a plurality of said chair frames are stackable.

4. A collapsible chair frame, comprising:

(a) a base;

(b) a seat back member;

(c) two side compression support members connected to said seat back member and connected to said base by removable sleeves;

(d) a center diagonal tension member removably connected to said base; and (e) a cantilever seat frame defining a seat portion of the collapsible chair frame, including:

(i) a cantilever rear outer seat frame member pivotably attached to each of said side compression support members at substantially the center of said seat portion;

(ii) two horizontal side leg supports, each one of which is connected to said cantilever rear outer seat frame member at one of the points where said cantilever rear outer seat frame member is pivotably attached to each of said side compression support members; and (iii) a front outer seat frame member which depends downwardly and across from said two horizontal side leg supports and is removably connected to said center diagonal tension member.

5. The collapsible chair frame of claim 4, wherein each of said removable sleeves comprise a tubular member having threaded openings substantially transverse to the sleeve longitudinal axis for receiving fastening screws to hold said sleeve in contact with said side compression support member and said base.

6. The collapsible chair frame of claim 4, wherein said diagonal tension member comprises threaded openings at both ends of the tension member, said openings being substantially transverse to the longitudinal axis of the tension member and capable of receiving fastening means to hold said tension member in contact with said base and said front outer seat frame member, whereby removal of said fastening means allows separation of said tension member from said chair frame.

7. The collapsible chair frame of claim 4, wherein said cantilever seat frame is rotatably attached to each of said side compression support member by a pivot assembly.

8. The collapsible chair frame of claim 4, wherein each of said horizontal side leg supports is capable of independent torsional movement.

9. A foldable chair frame, comprising:

(a) a base;

(b) a seat back member;

(c) two side compression support members connected to said seat back member and connected to said base by removable sleeves;

(d) a center diagonal tension member rotatably connected to said base; and (e) a cantilever seat frame defining a seat portion of the foldable chair frame, including:

(i) a cantilever rear outer seat frame member pivotably attached to each of said side compression support members at substantially the center of said seat portion;

(ii) two horizontal side leg supports, each one of which is connected to said cantilever rear outer seat frame member at one of the points where said cantilever rear outer seat frame member is pivotably attached to each of said side compression support members; and (iii) a front outer seat frame member which depends downwardly and across from said horizontal side leg supports and is rotatably connected to said center diagonal tension member.

10. The foldable chair frame of claim 9, wherein each of said removable sleeves comprise a tubular member having threaded openings substantially transverse to the sleeve longitudinal axis for receiving fastening screws to hold said sleeve in contact with said side compression support member and said base.

11. The foldable chair frame of claim 9, wherein said cantilever seat frame is rotatably attached to each of said side compression support members by a pivot assembly.

12. The foldable chair frame of claim 9, wherein each of said horizontal side leg supports is capable of independent torsional movement.

13. The foldable chair frame of claim 9, wherein said center diagonal tension member rotatably connected to said base further comprises a pair of collars, each of which is welded to said base and rotatably connected to said tension member.

14. The foldable chair frame of claim 9, wherein said front outer seat frame member rotatably connected to said center diagonal tension member further comprises a pair of collars, each of which is welded to said front outer seat frame member and rotatably connected to said tension member.

* * * * *

UNITED STATES PATENT OFFICE

CERTIFICATE OF CORRECTION

Patent No. 4,674,795 Dated June 23, 1987

Inventor(s) Jonathan M. Nelson

It is certified that error appears in the above-identified patent and that said Letters Patent are hereby corrected as shown below:

Column 2, line 53, "ohair" should be --chair--.

Column 4, line 6, "cross seotional" should be --cross sectional--.

Column 4, line 7, "oolar" should be --collar--.

Column 6, claim 1, line 60, --a-- should appear before the word "center".

Signed and Sealed this

Thirteenth Day of October, 1987

*Attest:*

DONALD J. QUIGG

*Attesting Officer*

*Commissioner of Patents and Trademarks*